United States Patent [19]

Yuan-Hsiang

[11] Patent Number: 4,477,985

[45] Date of Patent: Oct. 23, 1984

[54] SANITARY SANDALS

[76] Inventor: Chen Yuan-Hsiang, No. 300 Chon-Chan Rd., Lui-Chou Hsiang, Taipei Hsien, Taiwan

[21] Appl. No.: 384,733

[22] Filed: Jun. 3, 1982

[51] Int. Cl.[3] ..... A43B 3/12

[52] U.S. Cl. ..... 36/11.5; 36/9 A; 12/142 S

[58] Field of Search ..... 36/11.5, 9 A, 83, 8.1, 36/9 R, 104, 100, 101; 2/243 B; 12/142 S

[56] References Cited

U.S. PATENT DOCUMENTS

| | | | |
|---|---|---|---|
| D. 192,210 | 2/1962 | Webster et al. | 36/9 A |
| 311,018 | 1/1885 | Lord | 36/9 A |
| 1,817,623 | 8/1931 | Hervey | 36/11 X |
| 2,265,089 | 12/1941 | Turbin | 36/9 R |
| 2,611,977 | 9/1952 | Yamada | 36/9 A |
| 2,735,195 | 2/1956 | Eaton | 36/9 R |
| 2,764,823 | 10/1956 | Struble | 36/9 R |
| 3,204,346 | 9/1965 | Lockard et al. | 36/11.5 |
| 3,290,802 | 12/1966 | Fukuoka | 36/11.5 |
| 3,404,469 | 10/1968 | Prenovitz | 36/11.5 X |
| 4,030,212 | 6/1977 | Ito | 36/11.5 |
| 4,300,294 | 11/1981 | Riecken | 36/101 X |

FOREIGN PATENT DOCUMENTS

| | | | |
|---|---|---|---|
| 2461467 | 3/1981 | France | 36/11.5 |
| 507652 | 9/1937 | United Kingdom | 36/9 A |

*Primary Examiner*—Henry S. Jaudon
*Assistant Examiner*—Tracy G. Graveline
*Attorney, Agent, or Firm*—Balogh, Osann, Kramer, Dvorak, Genova, & Traub

[57] ABSTRACT

The sanitary sandals or slippers are made of different kinds of materials with proper flexibility. Especially, they are made of the mixture of paper and porous plastics. The material is molded into the sandals. The vamp and sole of the sandal are made of the same material. Once the material surface is folded back, its main body with the component of shoe strings turn into a solid form, a kind of easily made, economic in use, simple and convenient sandal.

6 Claims, 5 Drawing Figures

SANITARY SANDALS

BRIEF SUMMARY OF THE INVENTION

The sanitary sandals are made of paper produced by cutting the paper into the shape comprising a main body and sandal fastener, which are formed on a single plane, so that the sandal can be easily formed by folding the fastener so that its belt is inserted into a groove in a sole of the main body.

BRIEF DESCRIPTION OF THE SEVERAL VIEWS OF DRAWINGS

FIG. 5 illustrates additional embodiments of sandals.

PREFERRED EMBODIMENT

Sandals are our daily necessities of various kinds such as plastic slippers, rubber sandals, and cloth-made slippers. Sandals can be classified into household and outdoor types. Generally speaking, a slipper which is made of molded material is usually made in a mold or die with its various parts subjected to heavy pressure into forms which are assembled together to provide a finished product.

This invention is concerned with sandals suitable for room use, easily made and economical in cost. If they are used in a hotel, its sanitary problem can be solved. Once the sandals are used and thrown away, there are no infectious problems. Now, a comparison is made with ordinary sandals on their similarities and dissimilarities as follows:

(1) This invention is directed to a thin piece of material that is pressed into a product by a heavy press machine while ordinary sandals are made of plastics in a mold or rubber molded into a product, or their main parts and fasteners are respectively pressed in a mold and then assembled together as a finished product.

(2) The main part of a sandal body 11 and a fastener 12 are molded into an inseparable product. A front portion 12*d* of the fastener 12 is the extension of the front part of the sandal body 11. A rear portion 12*e* of the fastener 12 has ends linked by a belt 12*c* straddling the two ends. The mid-portion of the slipper body 11 has crevices 11*a* connecting with holes 11*b*, so that the rear portion 12*d* of the fastener can be inserted into the crevices 11*a* for assembly. The belt 12*c* can be placed underneath the sandal body 11 to link the sandal body 11 with the fastener 12.

(3) The fastener 12 has its rear portion 12*d* provided with folded pleats which provide more resilience in addition to its own elasticity to broaden its scope of applications. Ordinary sandals have no such device. Only a few kinds of expensive slippers have elastic bands at the location of the fastener to provide a similar function.

Figure 1:
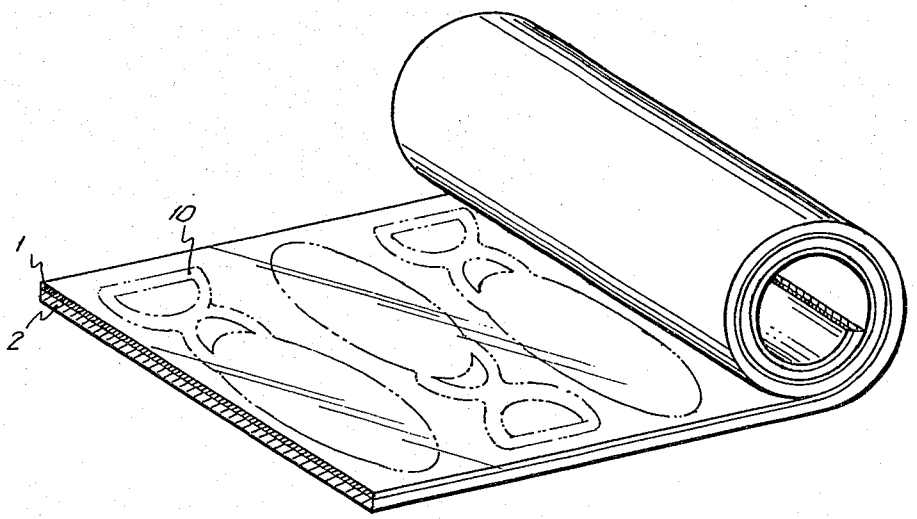
FIG. 1 shows a roll of synthetic material from which sandals can be made.
Figure 2:
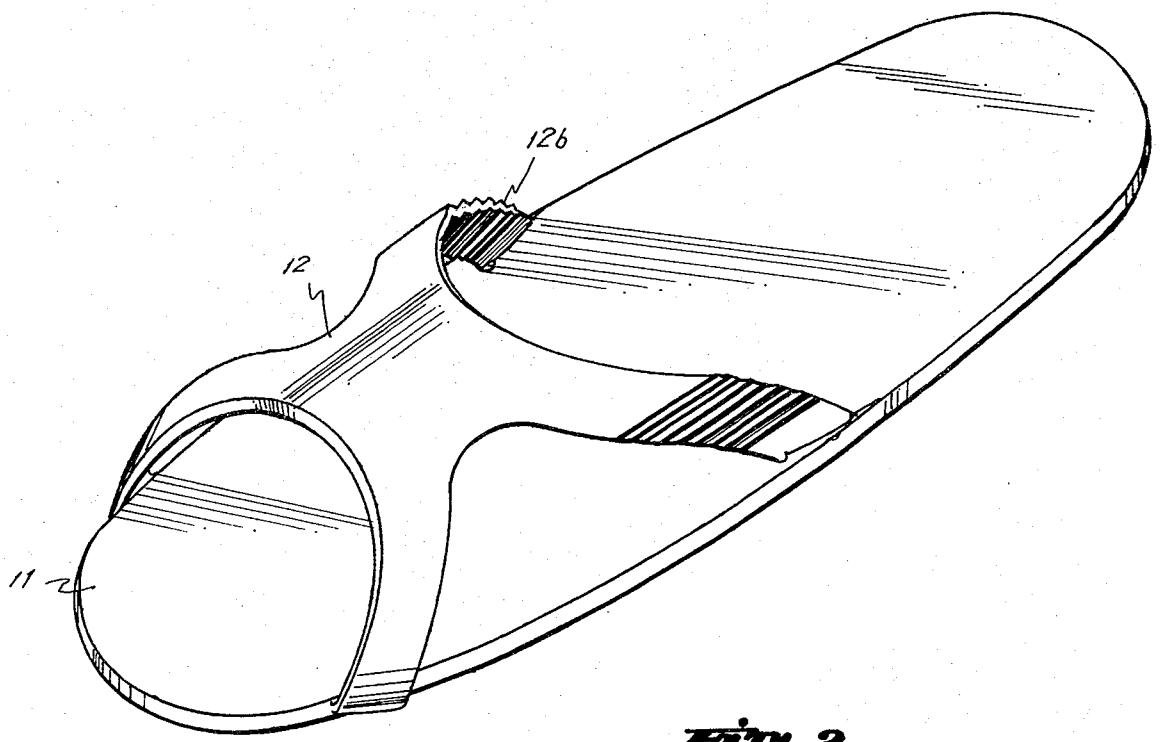
FIG. 2 shows a formed sandal having a fastener provided with pleats.
Figure 3:
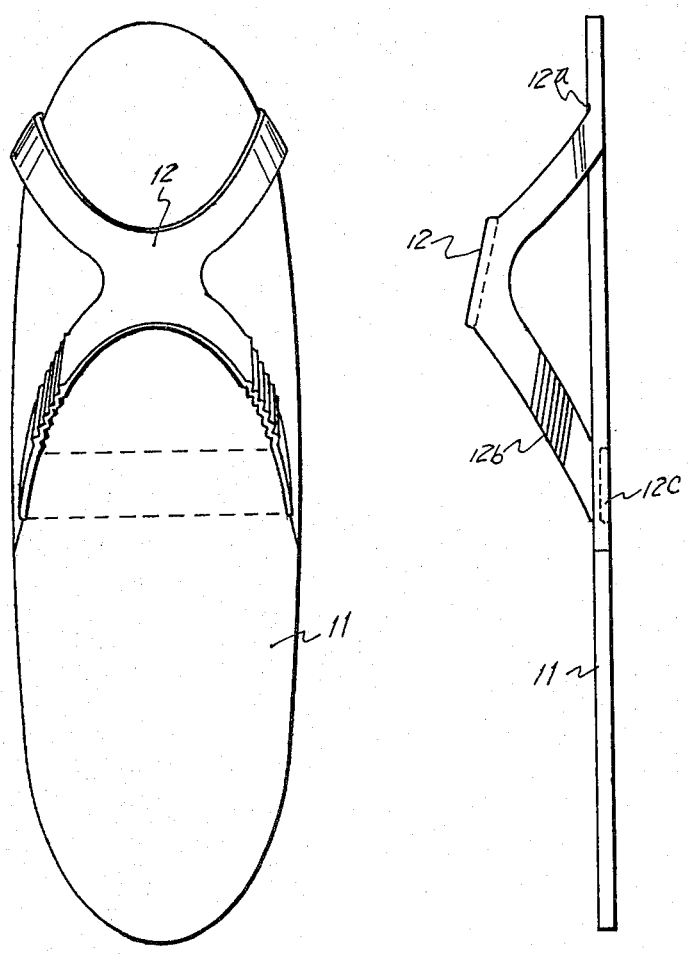
FIG. 3 is a top view and a side view of the formed sandal.
Figure 4:
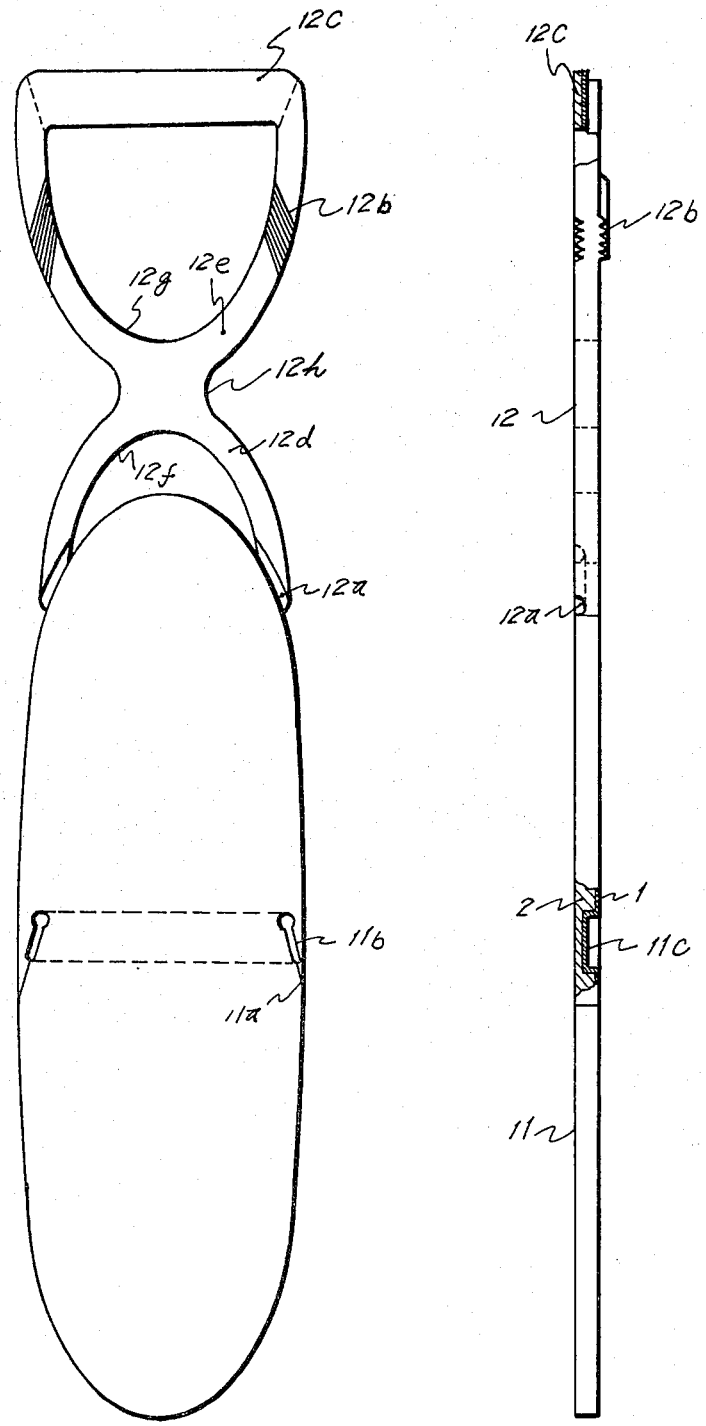
FIG. 4 is a top view and a side view of a sandal having a main body and a fastener molded in a single plane.
Figure 6:
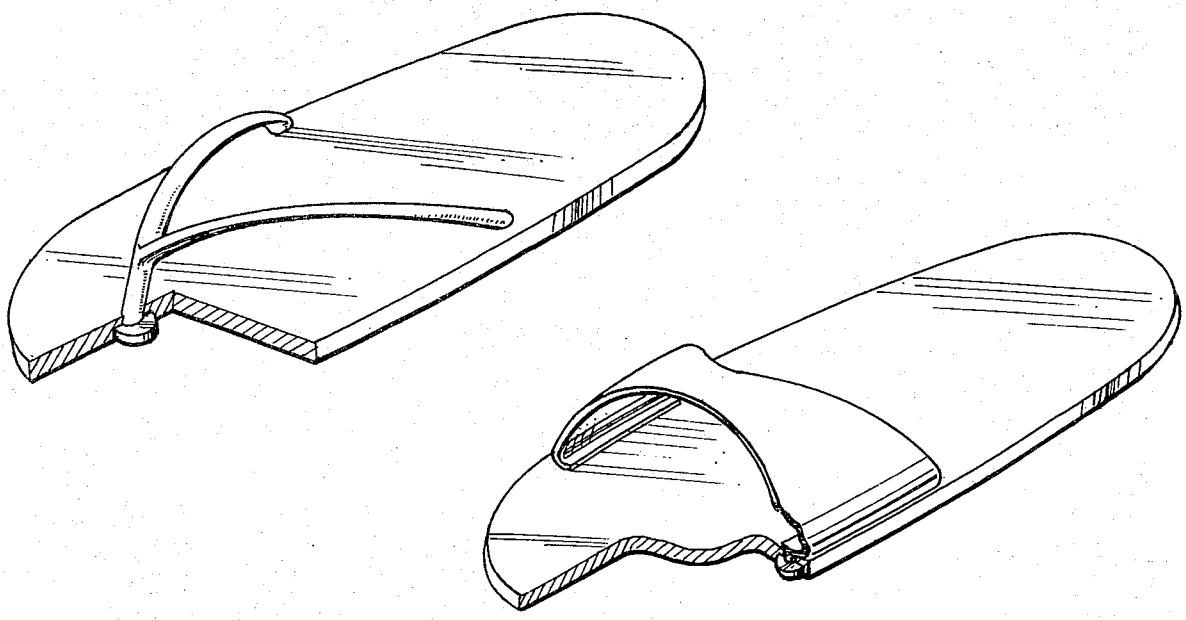

(4 ) As described above in (2), the linking of the belt 12*c* with the fastener 12 forms an integral part, their resilience depending upon the size of the cross-section of the fastener and their flexibility, which must be within a certain range as a result of limitation by the inlaid surface for the link of the conventional sandals. For that reason, the material to be used can be of lesser hardness. According to the experiments made by the inventor, the selected material shall be strengthened fibrous papers, nonwovens, porous PP & PE plastics or a porous plastic material serving as a soft layer 2 to be covered by one layer of highly flexible fibrous material layer. Thus formed, the sandal can be one of the most soft and pliable indoor sandals available. The composition of the material in this invention is a belt-shaped material (as shown in FIG. 1) which turns into a product under press. The material may be paper, non-weaving cloth, PP & PE porous material or the soft layer 1 as mentioned previously. FIG. 1 shows an imprinted form of slippers made before the material is subjected to the press in a mold. The user can assemble the components into sandals by means of its simple coupling method. The horizontal form (as shown in FIG. 4) includes the sandal body 11, and the two portions 12*b* and 12*d* of the fastener 12. The crevice 11*a* ends in a round component hole 11*b*. The shape of the crevice and the hole avoid concentrated breaking force in the material and thus increase the material strength at the crevice end. The crevices 11*a* are oblique inward and forward and are symmetrical to each other. The length of each crevice 11*a* is the width of a strap forming the rear portion 12*b*. The width of the component hole 11*b* is smaller than the thickness of the material of the strap so that the straps can be clamped firmly. The belt 12*c* is pressed firmly into a groove 11*c*, the width of which is the same as that of the belt. The area of the sandal body overlying the groove 11*c* is only half that of its original material thickness due to the fact that it was pressed out and thus left a coupling space in its half thickness for the belt.

As shown in FIG. 4, the extension in the front part of sandal body 11 is the fastener 12. The front portion 12*d* ends at the front part of the sandal body 11. At the coupling site between 12*d* and 11, there are arc grooves 12*a* which have been pressed and formed. The function of each arc groove 12*a* is to provide a clearance between the fastener and the sandal body 11. Because of the groove 12*a*, the thick material can be pressed into a thinner shape without the reduction of its strength, and it is easier to fold back the material at that point. The rear portion 12*e* has two ends ending in the belt 12*c* straddling on both ends which are made of the belt material and are located between arc rear cords 12*g* and outer fringe 12*h*. The arc groove 12*a* of the front portion 12*d* is a fold line which is to be bent upwardly and then backwardly to make a fastener insertion into the crevice 11*a*. The belt 12*c* is inlaid in the groove 11*c* (sole of the sandal body). The connecting part between the belt 12*c* and the rear portion 12*e* is inserted into the component hole 11*b* through the crevice 11*a*. Due to the fact that the width of the component hole 11*b* is smaller than the material thickness of the rear portion 12*e*, the rear portion can be clamped firmly without the loosening of the belt 12*c* that would fall out of the groove 11*c*.

The rear portion 12*b* will be in contact with the user's foot. On the rear portion 12*b*, there are provided pleats (See FIG. 4). During its press in the mold, the material is pressed into convex and concave shapes. The convex side of the pleats is on the same surface with the concave side of the rear portion 12*b*, and, therefore, during the fastener being folded back, the projected pleats are shown on the outer part of the fastener to avoid the incompatibility in content between the user's foot and the fastener. The pleats enhance the resilience to accommodate various sizes of feet. It can also increase the softness at the location between the rear portion 12*e* and arc fringe 12*g* to make the user comfortable in wearing it. That is one of the features of this invention. The pressed parts consist of roundish arc groove 12*a*, pleats, belt 12*c* and the groove 11*c*. The molding and pressing operations are made at the same time. If the location of their performance is arranged in proper order, the work can be simplified. The belt 12*c* can be made from material of lesser hardness to allow the pleats and to provide more resilience for various sizes of feet. The softness in wearing the slipper described in this invention is one of the features of the new product.

I claim:

1. A one-piece sandal made from a flat sheet of relatively soft resilient material, comprising a sandal body and a fastener, said body having a toe portion and a heel portion, said fastener having a front portion interlinked with a rear portion, said rear portion being integrally attached with said toe portion, the distal end of said fastener terminating in a belt, a groove molded transversely in the bottom of said body substantially midway between said toe and heel portions, a pair of crevices initiated from the outer periphery of the body and extending through the thickness of said body, each crevice being slanted inwardly toward the toe portion and disposed at the extremity of the groove, whereby said body and fastener are formed into a sandal by bending the fastener over the top of the body and inserting the heel portion through the rear portion to enable the placement of the belt into said groove and the placement of portions of the rear portion into said crevices.

2. A sandal according to claim 1, wherein said internal attachment of said front portion with said toe portion includes a pair of arc grooves to define clearances when the fastener is being bent over said body prior to the placement of said belt into said groove.

3. A sandal according to claim 1, wherein said crevices terminate in holes to provide relief to stress when said portions of said rear portion are positioned in said crevice.

4. A sandal according to claim 1, wherein the width of the crevices is slightly less than the thickness of the material forming said protions of the rear portion.

5. A sandal according to claim 1, said rear portion of said fastener comprising a pair of arced webs joined by said belt, each of said webs being provided with transverse pleats which provide resilience to said rear portion when engaging a wearer's foot.

6. A sandal according to claim 1, wherein the thickness of the belt is totally accommodated by the depth of the groove, whereby the bottom of the body exhibits a single plane.

* * * * *